US006062985A

United States Patent [19]

Rège

[11] Patent Number: 6,062,985

[45] Date of Patent: May 16, 2000

[54] GOLF FLAG STICK PLAY PACER

[76] Inventor: Kathleen Rège, 2429 Walnut Grove Ave., San Jose, Calif. 95128

[21] Appl. No.: 09/074,450

[22] Filed: May 6, 1998

[51] Int. Cl.[7] ..... A63B 57/00; A63B 69/36

[52] U.S. Cl. ..... 473/199; 368/107; 368/110; 368/112

[58] Field of Search ..... 473/199, 198; 368/10, 107, 108, 109, 110, 111, 112, 113

[56] References Cited

U.S. PATENT DOCUMENTS

| | | | |
|---|---|---|---|
| 4,268,915 | 5/1981 | Parmet | 455/158 X |
| 4,280,063 | 7/1981 | Yokomori et al. | 37/141.4 X |
| 4,303,243 | 12/1981 | Wolfe | 273/176 R X |
| 4,632,570 | 12/1986 | Kelsey | 368/107 X |
| 4,674,743 | 6/1987 | Hirano | 272/100 X |
| 4,811,312 | 3/1989 | Cole | 368/107 X |
| 4,875,579 | 10/1989 | Tak | 206/315.1 X |
| 4,991,155 | 2/1991 | Ken | 368/107 X |
| 5,086,390 | 2/1992 | Matthews | 364/410 X |
| 5,097,416 | 3/1992 | Matthews | 346/410 X |
| 5,193,078 | 3/1993 | Zink et al. | 368/107 X |
| 5,203,589 | 4/1993 | Tio | 280/816 X |
| 5,253,228 | 10/1993 | Truett | 368/82 X |
| 5,335,212 | 8/1994 | Bartos | 368/107 X |
| 5,357,487 | 10/1994 | Coleman, III | 368/10 X |
| 5,386,990 | 2/1995 | Smith | 273/32 H X |
| 5,400,302 | 3/1995 | Yamamoto et al. | 368/107 X |
| 5,430,693 | 7/1995 | Ganter et al. | 368/47 X |
| 5,523,985 | 6/1996 | Nixon | 368/107 |
| 5,646,911 | 7/1997 | Davis | 368/10 X |
| 5,668,782 | 9/1997 | Crawford | 368/107 X |
| 5,745,439 | 4/1998 | Nepple | 368/10 X |

*Primary Examiner*—Lee Young
*Assistant Examiner*—Binh-An Nguyen
*Attorney, Agent, or Firm*—The Kline Law Firm

[57] ABSTRACT

A golf play pacing device that is contained in the flag stick itself. The device includes an orientation sensing switch in the flag stick that is activated when the stick moves through an arc of approximately 45°, and reactivated when the stick is returned to perpendicular. The orientation switch controls circuitry that measures the time expired since the last reset of the device, and activates an alarm mechanism when that time is expired. The alarm mechanism includes visual alarms for the golfers and alarm capability for third parties. A sequence to monitor the putting time of players on the green can also be activated.

12 Claims, 5 Drawing Sheets

GOLF FLAG STICK PLAY PACER

FIELD OF THE INVENTION

The present invention relates generally to a timing and alarm device, and more particularly is a means to monitor the pace of play on a golf course that is either built into the flag sticks or is added onto existing flag sticks.

BACKGROUND OF THE INVENTION

Golf is one of the oldest and most popular games in the world. The game is played in a great many countries, and is enjoyed by a tremendously broad spectrum of participants. However, it is the broad-spectrum appeal of the game that can lead to some problems in play.

Due to the nature of the game of golf, a large amount of land area is required for each golf course. This fundamental requirement of a large amount of space means that in populous areas, where demand is greatest, there are relatively few courses. Because of the game's great popularity, the capacity of these courses is sometimes pushed to the limit or exceeded. When a course is near capacity, maintaining the pace of play becomes critical. Even on a course that is not at all crowded, a golfer or group of golfers playing behind a slow group can have their enjoyment of a round diminished greatly due to the delay caused by the preceding group. The delay is due not only to the wide range of skill levels present on a course, but slow play is also sometimes simply a matter of players not having an effective means of being made aware of the pacing of their play.

Accordingly, there have been many efforts made in terms of prior art devices that track and/or notify golfers of the pace of their play. One such device is the "Variable Time Segment Pace Timing Device" of Coleman, U.S. Pat. No. 5,357,487, issued Oct. 18, 1994. The device includes a plurality of timing elements that can be programmed for the amount of time that the player desires to be allotted for each hole of the course. The timing can be varied to allow for changing conditions including number of players in a group and daylight hours available. The device is to carried by at least one of the golfers.

Another tracking method is the "System for Monitoring Play of a Golfer" of Mathews, U.S. Pat. No. 5,086,390 and 5,097,416, issued Feb. 4, 1992, and Mar. 17, 1992 respectively. This system utilizes transmitters positioned at the tees of each of the holes of the course to activate receivers carried by the golfers. The system also includes a means of notifying the course management of slow players.

Another device to time play is the "Golf Course Timer to Alleviate Slow Play" of Nixon, U.S. Pat. No. 5,523,985, issued Jun. 4, 1996. This device is worn like a wristwatch by the golfer, and includes means to set the desired time to complete the round. The hour indicators of a normal wristwatch are replaced with the numbers of the holes of the golf course.

Still another timing device is the "Golf Course Timing Method and System" of Smith, U.S. Pat. No. 5,386,990, issued Feb. 7, 1995. This device includes provisions for specifying the time to be allotted for each hole, for tracking the time of play, and for communicating the information to course personnel.

The "Golf Clock" of Bartos, U.S. Pat. No. 5,335,212, issued Aug. 2, 1994, is another example of a programmable clock device. This device includes a digital display and is intended to be mounted on the user's golf cart.

An earlier version of a timing system is disclosed in "System and Method of Timing Golfers on a Golf Course" by Wolfe, U.S. Pat. No. 4,303,243, issued Dec. 1, 1981. This system allows the users to determine whether or not they are playing according to a prescribed time limit for each hole, as well as comparing their playing pace to other groups on the course. Unfortunately, the device does not display the timing for a current hole, but rather the display is made on the succeeding tee box.

The prior art devices are subject to one or more of the following shortcomings: First, the current art assumes a willingness of the players themselves to activate and monitor the devices.

Another drawback to prior art devices is that they are dependent on the golfers' start time as opposed to actual playing conditions on the course.

Another drawback to prior art devices is that they can be easily ignored. The mobile monitoring units can be placed in a golf bag or cart out of sight and thus can be completely ignored. Display boards or clock posted at tee boxes may also be unnoticed by the golfers.

Accordingly, it is an object of the present invention to provide a golf play pacing device that is mounted directly in the flag sticks of the golf course.

It is a further object of the present invention to provide a pacing means that is dependent on the playing time for each hole relative to the pace on the course, not simply a function of the start time of a round.

It is a still further object of the present invention to provide a device that remains in a passive state until a pacing parameter has been exceeded. This characteristic of the device ensures that golfers who are not causing a pacing problem are not required to be involved in any way with the pacing device.

It is yet another object of the present invention to provide a signal display that is very conspicuous so that it is difficult for the players to ignore the pacing warnings.

SUMMARY OF THE INVENTION

The present invention is a golf play pacing device that is contained in the flag stick itself. The device comprises an orientation sensing switch in the flag stick that is activated when the stick is moved through an arc of approximately 45°, and reset when the stick is returned to perpendicular. The orientation switch controls circuitry that measures the time expired since the last reset of the device, and activates an alarm mechanism when that time is expired. The alarm mechanism includes visual alarms for the golfers and alarm capability for third parties. A sequence to monitor the putting time of players on the green can also be activated.

An advantage of the present invention is that its operation is automatically controlled by actions inherent to playing golf, (removal of the flag stick from the cup), and thus does not require affirmative actions by the golfers.

Another advantage of the present invention is that it is controlled by the pace of play on the course, not the start time of individual golfers.

A still further advantage of the present invention is that the timing mechanism can be adjusted to accommodate variable factors affecting the course.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
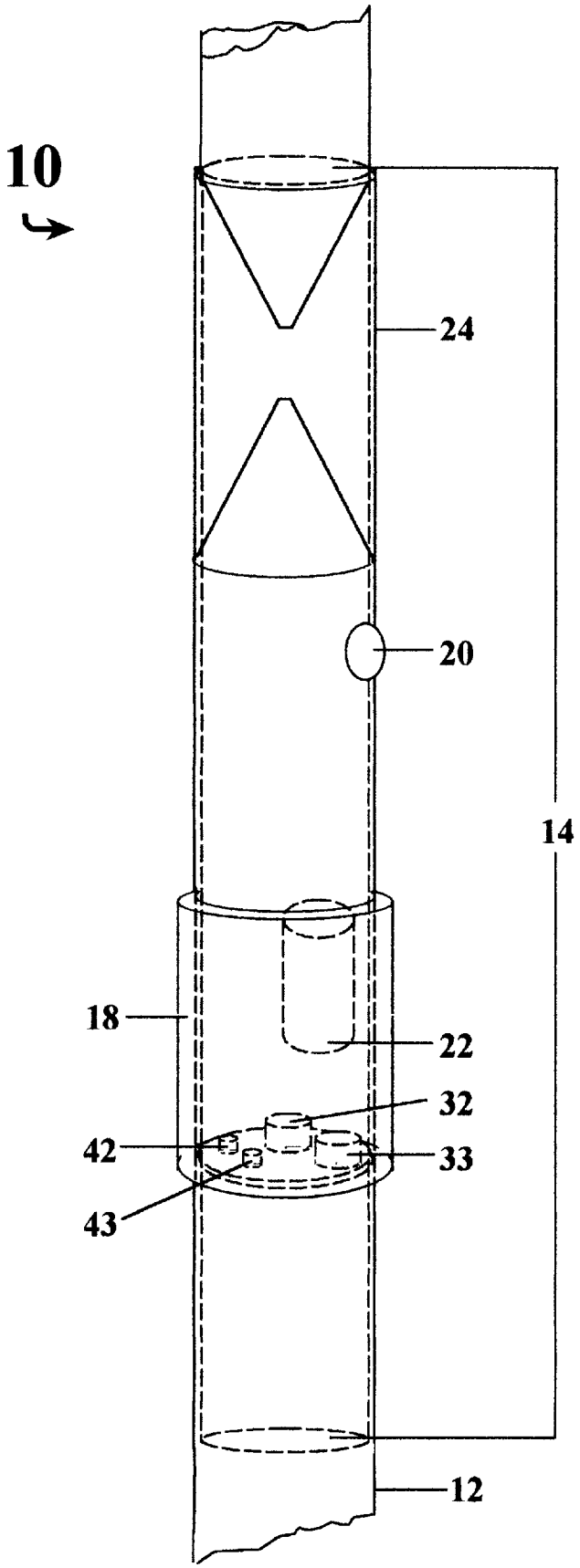
FIG. 1 is a perspective view of the pacing device of the present invention built into a flag stick.
Figure 2:
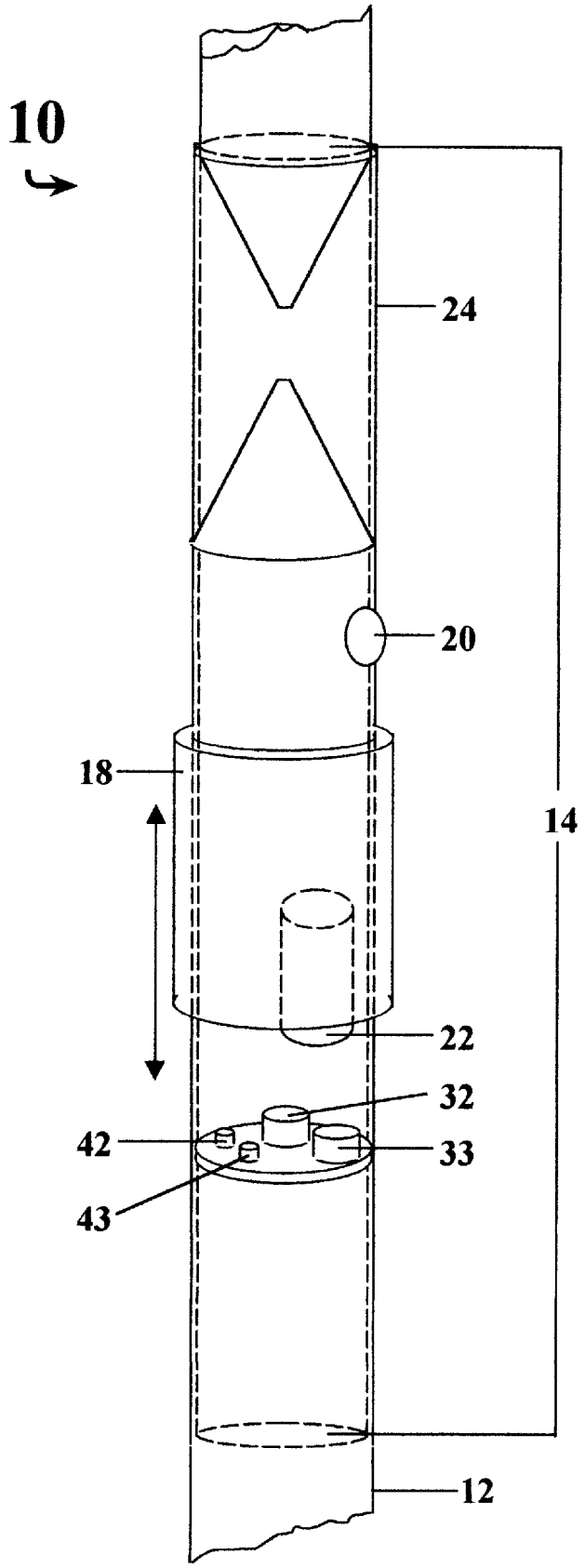
FIG. 2 is a perspective view of the pacing device of the present invention built into a flag stick with the access sleeve open to expose the interior components.

The present invention is a golf play pacing device 10 that is mounted in or on a flag stick or pin 12. A first preferred embodiment of the device is illustrated in FIGS. 1 and 2. In this embodiment, the device is built-in to the flag stick 12. The controlling circuitry 14 for the built-in unit 10 is contained within a hollowed housing compartment on the flag stick 12. A sliding sleeve 18 provides access to a power source (generally batteries) 22 and to the timing switches (described below).

In order to alert golfers when they have exceeded a designated time for play on a given hole, an alarm light module 24 is included in the device. The alarm light module 24 includes flashing or strobe lights 241 that serve as a highly noticeable signal of exceeding time for play. The cutoff switch 20 is primarily used to deactivate the alarm light module 24 after the preset time limit has been exceeded to allow golfers to chip onto the green or to finish putting without distraction. When the cutoff switch 20 is activated, the device is put into a sleep mode for a given time period.

Figure 3:
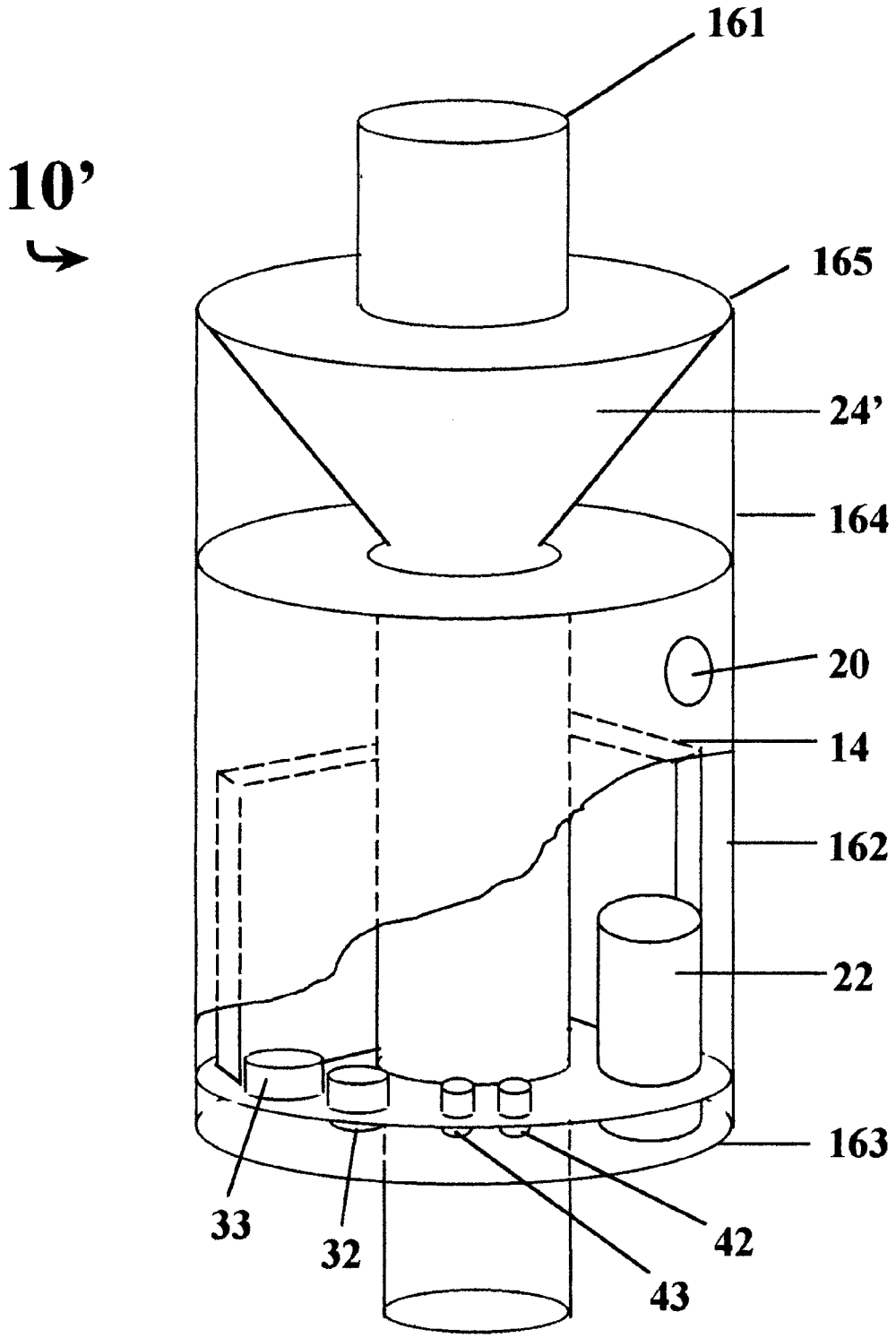
FIG. 3 is a perspective view of the pacing device of the present invention as an add-on unit.

An alternate embodiment of the device is shown in FIG. 3. This embodiment presumes that the device will be an add-on unit 10' that is adapted to fit over an existing flag stick. The add-on unit 1' includes controlling circuitry 14, a cutoff switch 20, and a power source 22 that are functional equivalents to those of the built-in unit 10.

In addition, the add-on unit 1' includes a cylindrical housing that contains the elements of the unit 10'. The housing includes a central throughway 161 that slips over the existing flag stick. After the housing is slipped onto the flag stick, it is clamped on both the top and bottom so that its position on the stick cannot change significantly.

A lower section 162 of the housing contains the circuitry 14 and the power supply 22. A lower end cap 163 is removably attached to the lower section 162 of the housing to allow access to the interior of the lower section 162. An upper section 164 of the housing contains the alarm light module 24'. The alarm light module 24' includes flashing or strobe lights 241 that serve as a highly noticeable signal of the players exceeding time for play. A top end cap 165 is affixed to the upper section 164 of the housing.

Figure 4:
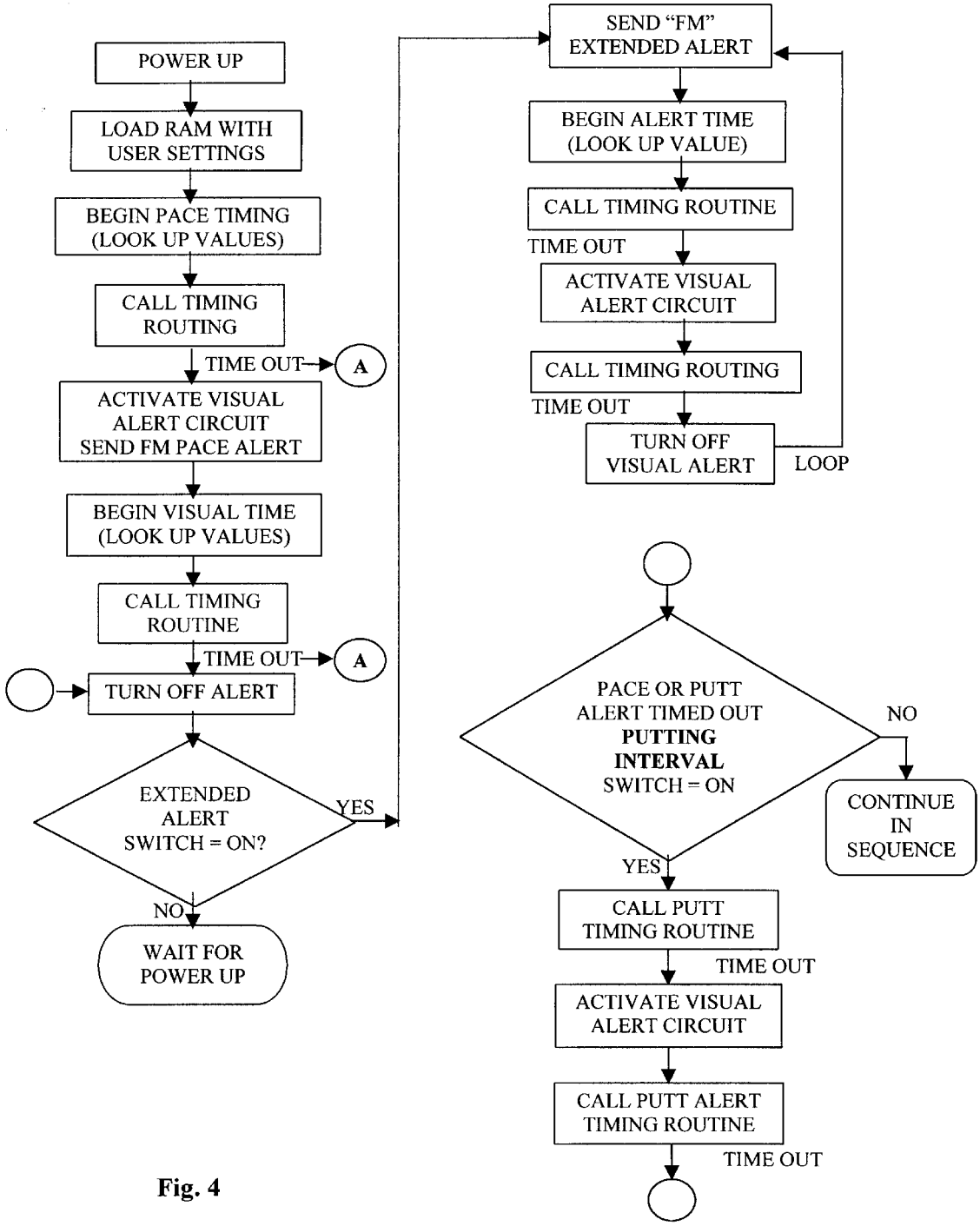
FIG. 4 is a flow chart of the operation of the CPU of the pacing device of the present invention.
Figure 5:
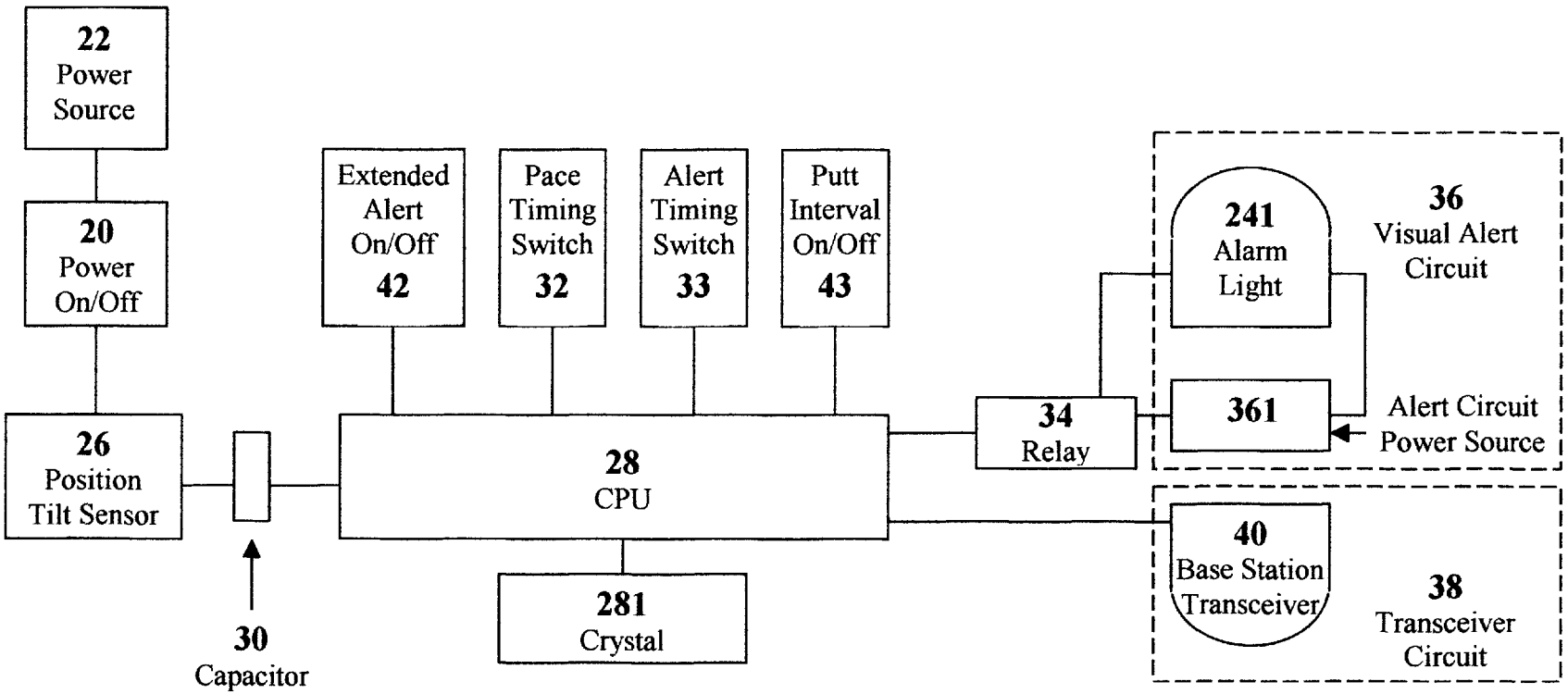
FIG. 5 is a schematic circuit diagram of the pacing device of the present invention.

Referring now chiefly to FIGS. 4 and 5, power on of the device is activated by moving the flag stick. When the unit 10, 1' is moved through an arc of approximately 45°, a position tilt sensor 26 is activated, interrupting power supply to a CPU 28. (The arc which triggers the tilt sensor 26 can vary depending upon which specific tilt sensor is used in a particular application.) This indicates to the CPU 28 that the flag stick has been returned to vertical, and that the pace interval is to be reset by means of an initialization sequence. The CPU 28 is protected from contact bounce in the power source 22 by means of an in-line capacitor 30. The CPU 28 also includes a clock driven by a crystal 281.

The duration of the pace time intervals and the alert time intervals are established by pace timing switch 32 and alert timing switch 33 respectively. Each switch can be set to one of a plurality of preset time interval values that the user of the device will choose according to how he wants to pace the play on the course on a given day. If the user desires to move play as quickly as possible, he will set the pace timing switch 32 to the shortest preset time. If the user chooses a more leisurely pace, the pace timing switch 32 will be set to a greater pre-programmed time period.

The function of the units 10, 1' can best be understood with reference to the flow chart of the CPU program (FIG. 4) and the schematic circuit diagram (FIG. 5). The CPU program includes several sub-routines that control the function of the device.

The initialization sequence (a) clears and resets the RAM locations, (b) reads the pace and alert timer switch settings, (c) reads the extended timer and putting switch states, and (d) if the device is set for FM transmission, the CPU reads the unique digital code programmed for the unit. Depending on the settings found when the pace and alert timer settings are read, lookup tables are indexed and the associated timing values are stored in the appropriate RAM locations.

After the pace timing values have been established in the program, the program enters a Pace Timing sequence. The program remains in this state for the chosen pace time interval, or until the time out state is triggered by a player moving the flag stick far enough to activate the tilt sensor 26.

If the playing pace time interval expires before the time out state is activated, two actions occur that trigger alarm signals: (a) the relay 34 is closed, thereby enabling the Visual Alert circuit 36 and turning on the alarm light 241 in the alarm light module 24, 24', and (b) the FM transceiver circuit 38 (if active on the particular installation), emits a signal to a base station transceiver 40. The base station transceiver 40 is then able to signal to management that the playing pace interval has been exceeded, and that an alert has been activated.

Once the playing pace interval has been exceeded and the alert has been activated, the program enters an Alert Timing sequence. The device remains in a visual alert on state until the alert time interval time elapses or until the time out state is activated. The alert signal is terminated by releasing the relay 34, thereby deactivating the alarm light module 24, 24' and turning off alarm light 241. If a base station transceiver 40 is in use, the FM transceiver circuit 38 stops sending the signal to the base station transceiver 40 to end the alert signal.

If the alert signal is terminated by the expiration of the chosen alert time interval as opposed to the time out state being activated, the program must check the state of extended alert on/off switch 42. If extended alert on/off switch 42 is on, the program will then trigger the Extended Alert sequence. In the Extended Alert state, the program enters a cycle in which it flashes the alarm light 241 on and off. When the preset extended alert time period has elapsed, relay 34 is released so that the Visual Alert circuit 36 is disabled, thereby leaving the device in a sleep state. Conversely, if switch 42 is set to off when the Alert Timing sequence has expired, the device simply enters the sleep state directly upon expiration of the alert time interval and awaits restarting of the initialization sequence.

If the time out signal is received either during the Pace Timing sequence (before expiration of the playing pace time interval), or during the Alert Timing sequence (before the expiration of the alert timing interval), the Putting Interval sequence is activated. Receipt of the time out signal always indicates that the players have reached the green, removed the flag stick from the cup, and are ready to putt.

The Putting Interval sequence is similar to the Pace Timing sequence. The program calls up a preset putting time interval, and monitors the time. If the putting time interval is exceeded, the Visual Alert sequence is activated in the same manner as when the Pace Timing interval is exceeded. A separate Putting Time Alert interval is stored in the program, and determines the length of time that the alert alarm is activated.

Thus, when play is continuous, the unit 10, 10' will be operated by the golfers removing the pin from the cup so that the flag stick is tilted significantly, and then replacing the pin in a vertical position. In the preferred embodiment, the flag must be moved through an arc of approximately 45°. The software for the program contains provisions to eliminate the effect of slight natural movements of the pin.

When the pin is moved through a sufficient arc, the tilt sensor signal to either reset the device or activate one of the timing sequences. If the Putting Interval has been enabled, the putting interval sequence is activated if a signal is received from the tilt sensor 26 during one of the timing intervals. The Putting Interval sequence monitors the putting time of players in the same way as the Pace Timing sequence monitors the approach play.

By using the device of the present invention, golf course management will be able to pace the play according to conditions. An acceptable time range for the course pace will be loaded into the interval timing switch settings. Within the acceptable time range will be a plurality of time alternatives, each corresponding to one of the settings on the interval timing switch.

In this manner, golfers will be alerted by the alarm lights when they have exceeded the appropriate time for a given hole. When the base station transceiver 40 is active, course management will also be notified, enabling them to take corrective action if necessary.

By controlling the pace of play in this manner, course management will be able to maximize the efficiency of use of the course, thereby ensuring maximum enjoyment for all users.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A golf play pacing device comprising:

timing means to measure a specified play interval, play interval setting means to specify a duration of said play interval, alert means to generate a first alert signal when said play interval has been exceeded, alert interval setting means to specify a duration of a first alert interval, and activation means to reset and activate said timing means, said activation means generates a signal when a flag stick is moved through a preset arc; and wherein said device is activated by said activation means to start said timing means with said signal, said timing means in turn triggers said alert means if said play interval is exceeded before a time out signal is generated by said activation means, said first alert signal continues through said duration of said first alert interval unless said first alert interval is terminated by receipt of said time out signal.

2. The golf play pacing device of claim 1 wherein:

said timing means further includes means to measure a specified putting interval, measurement of said putting interval is begun by receipt of said time out signal, said timing means triggers said alert means if said putting interval is exceeded before a second time out signal is generated by said activation means.

3. The golf play pacing device of claim 1 wherein:

said alert means includes means to trigger a base device remote from play pacing device.

4. The golf play pacing device of claim 3 wherein:

said means to trigger a base device comprises an FM signal.

5. The golf play pacing device of claim 1 wherein:

said device further comprises an extended alert means, said extended alert means is activated when said first alert interval expires without receipt of said time out signal, said extended alert means provides a second alert signal when said extended alert means is activated, said second alert signal continues for an extended alert interval or until said time out signal is received.

6. The golf play pacing device of claim 1 wherein:

a manual cutoff switch is included to manually terminate said first alert signal.

7. The golf play pacing device of claim 5 wherein:

a manual cutoff switch is included to manually terminate said first and said second alert signals.

8. The golf play pacing device of claim 1 wherein:

said golf play pacing device is integral to the flag stick.

9. The golf play pacing device of claim 1 wherein:

said golf play pacing device is an independent element affixed to the flag stick.

10. The golf play pacing device of claim 1 wherein:

said preset arc is approximately 45°.

11. The golf play pacing device of claim 1 wherein:

said first alert signal is a visual signal.

12. The golf play pacing device of claim 1 wherein:

said second alert signal is a flashing visual signal.

* * * * *